US008131005B2

(12) United States Patent
Lemarquand et al.

(10) Patent No.: US 8,131,005 B2
(45) Date of Patent: Mar. 6, 2012

(54) ELECTRODYNAMIC TRANSDUCER INCLUDING A DOME WITH A FERROFLUID SUSPENSION

(75) Inventors: Guy Lemarquand, Le Mans (FR); Bernard Richoux, Montoire (FR); Valérie Lemarquand, Le Mans (FR)

(73) Assignees: Universite du Maine, Le Mans (FR); Gilles Milot, Mayet (FR)

( * ) Notice: Subject to any disclaimer, the term of this patent is extended or adjusted under 35 U.S.C. 154(b) by 909 days.

(21) Appl. No.: 12/092,591

(22) PCT Filed: Nov. 2, 2006

(86) PCT No.: PCT/FR2006/051132

§ 371 (c)(1),
(2), (4) Date: Jul. 9, 2008

(87) PCT Pub. No.: WO2007/051948

PCT Pub. Date: May 10, 2007

(65) Prior Publication Data

US 2008/0285788 A1 Nov. 20, 2008

(30) Foreign Application Priority Data

Nov. 3, 2005 (FR) ..... 05 53330

(51) Int. Cl.
*H04R 9/06* (2006.01)

(52) U.S. Cl. ..... 381/415; 381/362; 381/418; 381/423; 381/430

(58) Field of Classification Search ..... None
See application file for complete search history.

(56) References Cited

U.S. PATENT DOCUMENTS

| | | | | |
|---|---|---|---|---|
| 5,335,287 | A | 8/1994 | Athanas | |
| 5,490,524 | A * | 2/1996 | Williams et al. | 128/849 |
| 5,894,524 | A * | 4/1999 | Kotsatos et al. | 381/397 |

FOREIGN PATENT DOCUMENTS

| | | | |
|---|---|---|---|
| DE | 102 07 561 | C1 | 7/2003 |
| GB | 1 599 506 | A | 10/1981 |
| JP | 60-259089 | A | 12/1985 |

* cited by examiner

*Primary Examiner* — Charles Garber
*Assistant Examiner* — Yasser Abdelaziez
(74) *Attorney, Agent, or Firm* — Young & Thompson

(57) ABSTRACT

The invention relates to an electrodynamic transducer (1) with a dome type diaphragm (2), comprising an electrodynamic motor with a coil (6) borne by a mandrel (3) integral with the diaphragm suspended to a yoke (7), the coil being placed in an air gap of a vertical free space in which it can move and which is defined, toward the center, by an internal magnetic construction (4), and toward the periphery, by an external magnetic construction (5), wherein the suspension comprises neither peripheral suspension nor internal suspension, the transducer comprises at least two magnetic field confinement means (11) in the air gap in order to form by mean of a ferromagnetic liquid at least two ferrofluidic seals (12, 13, 14) stepped in the air gap, fulfilling at least the guidance of the coil and the pneumatic tightness between the front and rear faces of the diaphragm, at least one of the ferrofluidic seals being continuous. Application to loudspeakers.

20 Claims, 1 Drawing Sheet

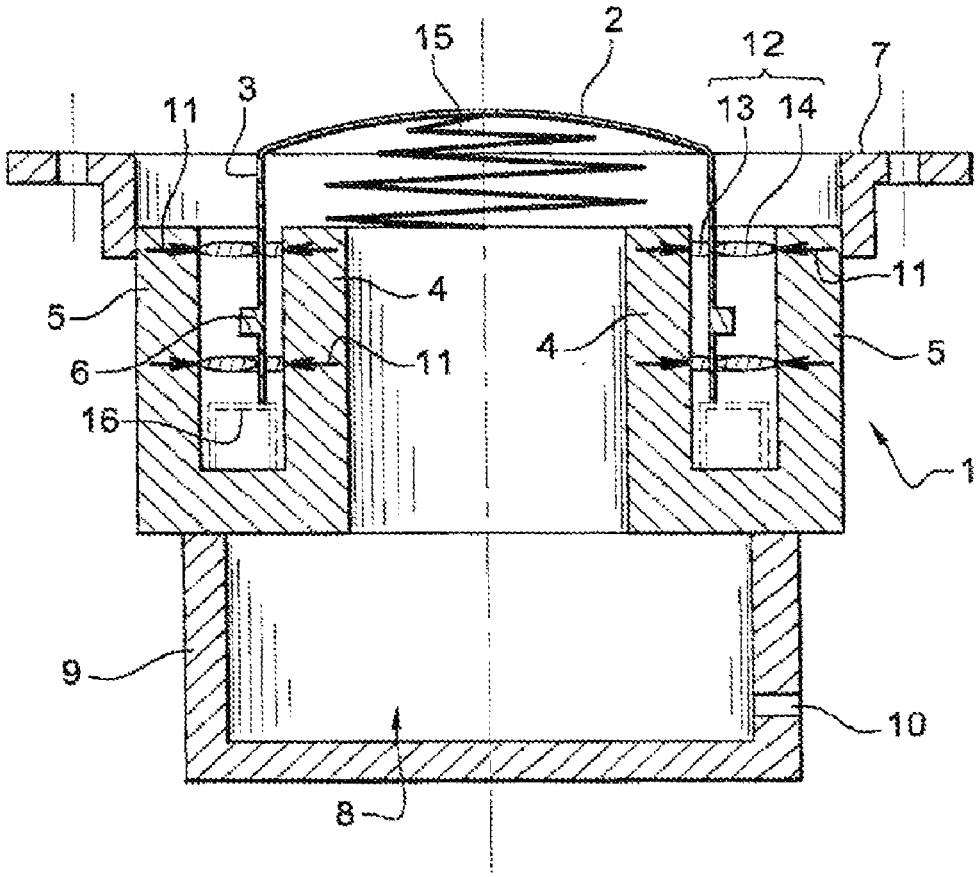
15
2
12
7
3
11
13
14
11
4
5
4
5
6
11
16
1
9
10
8

ELECTRODYNAMIC TRANSDUCER INCLUDING A DOME WITH A FERROFLUID SUSPENSION

The present invention relates to ferrofluidic suspension, dome type electrodynamic transducer, as well as the applications thereof to loudspeakers, geophones, microphones or the like.

BACKGROUND OF THE INVENTION

Axisymmetric, moving coil type electrodynamic loudspeakers generating acoustic waves in response to a current are known. The moving coil borne by a mandrel is integral with a diaphragm, and there exists two main types of loudspeakers according to the implementation of the diaphragm, the cone type and the dome type loudspeakers.

The general operating principle of a loudspeaker is based on the possibility to set in motion a cylindrical coil carrying an electric current and placed in a static magnetic field created by one or more annular or cylindrical fixed permanent magnet (s) which magnetization orientation is parallel to the revolution axis of the loudspeaker, a plurality of ferromagnetic parts channeling the magnetic field so as to bring him radially relative to the coil. The air gap is the place where the coil is located, the coil moves in a free space between faces of internal (toward the central symmetry axis of the loudspeaker) and external (toward the periphery of the loudspeaker) magnetic constructions (generating and/or channeling a magnetic field according to whether they comprise a magnet or not), relative to the mandrel. In the following, it will be referred to internal volume for the free space (comprising the internal part of the air gap) comprised between the mandrel and internal magnetic construction and to external volume for the free space (comprising the external part of the air gap) comprised between the mandrel and external magnetic construction. Magnetic constructions classically implemented in such loudspeakers use ferromagnetic parts to loopback the magnetic field of the magnet(s) in order for it to be able to go through the coil in this air gap. Finally, a loudspeaker comprises a rigid supporting construction called "frame" and enabling the basic components of the loudspeaker to be held in defined static and dynamic structural and functional relations.

In order for the coil to be correctly guided in the air gap, in particular for it not to rub against the edges of the vertical free space/air gap, and to be brought back to a defined rest position in absence of current, it is implemented suspension means of edge type (between the periphery of the diaphragm and the frame) and "spider" type (between the coil-bearing mandrel or the diaphragm and the frame). Besides the double guiding function, these suspension means also fulfill a pneumatic sealing function (in particular the edge) between the faces of the diaphragm, so as to avoid an acoustical short-circuit between the faces of the diaphragm, and a returning function (the edge and the spider) of the coil to a defined rest position.

For more precisions about the construction and the operation of loudspeakers, general explanations and examples about loudspeakers can be found for example in "HIGH PERFORMANCE LOUDSPEAKERS" by Martin Colloms, edited by WILEY, ISBN 0471 97091 3 PPC.

SUMMARY OF THE INVENTION

The present invention proposes to suppress the classical means of suspension for transducers and specially suspension means of edge and spider type in a dome type loudspeaker (circular, or even elliptical), the suspension being provided by implementation of ferrofluidic seals between the coil-bearing mandrel and the edges of the vertical free space in order to ensure at least a double guidance of the coil and a pneumatic tightness in the transducer.

Therefore, the invention relates to an electrodynamic transducer with a diaphragm comprising an electrodynamic motor in a yoke and in which can move a coil borne by a mandrel integral with the diaphragm, the mandrel being a shape generated by a globally linear generating line, the coil being placed in an air gap of a vertical free space in which it can move and which is defined, toward the center of the transducer, by an internal magnetic construction (which generates and/or channels the magnetic field according to whether it comprises a magnet or not), and toward the periphery of the transducer, by an external magnetic construction (which generates and/or channels the magnetic field according to whether it comprises a magnet or not).

According to the invention, the transducer comprises neither peripheral suspension nor internal suspension, the peripheral suspension being a suspension between the periphery of the diaphragm and the yoke, the internal suspension being a suspension between the diaphragm or the mandrel and the yoke, and the transducer comprises at least two magnetic field confinement means (depending on/integrated in or independent from the magnetic constructions) in the vertical free space in order to form by mean of a ferromagnetic liquid at least two ferrofluidic seals stepped in the vertical free space, fulfilling at least a double guidance of the coil and the pneumatic tightness between the front and rear faces of the diaphragm, at least one of the ferrofluidic seals being continuous.

In various embodiments of the invention, following means are used, which can be used alone or in any technically possible combinations:

the transducer is a geophone, the transducer is a microphone, the transducer is a loudspeaker, the diaphragm is a dome, the yoke is a frame, the peripheral suspension is an edge and the internal suspension is a "spider", the loudspeaker is of plane diaphragm (emitting part) type, the loudspeaker is of concave diaphragm (emitting part) type, the loudspeaker is of convex diaphragm (emitting part) type, the loudspeaker is of concave and convex diaphragm (emitting part) type, (both concave and convex in different areas), the magnetic field confinement means are inside the internal and/or external magnetic construction, the magnetic field confinement means are outside the internal or external magnetic construction (specific devices are thus added, a traditional internal/external magnetic construction can thus be used and one or more specific magnetic field confinement devices can be added), at least one of the ferrofluidic seals is discontinuous along the circumference of the mandrel, at least one of the ferrofluidic seals is continuous along the circumference of the mandrel (it is pneumatically tight and allows isolation of the rear part of the diaphragm from the environment and avoids an acoustical short-circuit because of the absence of the diaphragm peripheral suspension, specially of the edge type), the bottom of the vertical free space side opposite to the diaphragm (dome) is closed (air tight, and an external and unilateral continuous ferrofluidic seal is then sufficient to ensure the pneumatic tightness of the rear face of the diaphragm), the bottom of the vertical free space side opposite to the diaphragm is opened (an internal and unilateral continuous seal is then sufficient to ensure the pneumatic tightness of the rear face of the diaphragm), the seals are arranged at a high position on a same side of the coil(s) (either all above or all below), in case of several coils, at least one of the seals is above or below the set of coils (the other seal(s) can be located between the coils or completely on the other side of the coils), advantageously, the seals are arranged at a high position on either side of the coil (in the case of several coils, two terminal seals can be provided on either side of the coils and/or seals can be provided between each coil/set of coils), at least one of the ferrofluidic seals is an internal and unilateral seal, the ferromagnetic liquid of said seal being arranged inside the internal volume (the internal volume is inside the coil-bearing mandrel, the ferromagnetic liquid being therefore located between the mandrel and the internal magnetic construction), at least one of the ferrofluidic seals is an external and unilateral seal, the ferromagnetic liquid of said seal being arranged inside the external volume (the external volume is outside the coil-bearing mandrel, the ferromagnetic liquid being therefore located between the mandrel and the external magnetic construction), at least one of the ferrofluidic seals is a bilateral seal, the ferromagnetic liquid of said seal being arranged inside the external volume and inside the internal volume, substantially at the same height for a same bilateral seal, the transducer comprises only unilateral ferrofluidic seals, either exclusively external or exclusively internal, advantageously, the ferrofluidic seals are arranged in the space in which the volume is the most reduced (in practice, on the face of the mandrel which does not bear the coil), the ferrofluidic seals are external and unilateral seals, the coil is arranged inside the internal volume on the internal face of the mandrel and, when the seals are internal and unilateral seals, the coil is arranged inside the external volume on the external face of the mandrel, the transducer further comprises a return mean for the coil, the transducer further comprises a return mean for the coil, selected among one or more of the following means:

loading of the diaphragm by a closed volume on the backside of the dome, the internal magnetic construction being opened toward the closed volume;

loading of the diaphragm by a closed volume on the backside of the dome, the internal magnetic construction being opened toward the closed volume which comprises an adjusting device for the internal pressure thereof, specially by adjustment of the temperature of the air contained in said closed volume (for a long-term balancing of the pressures between the closed volume and the external environment, with a long time constant relative to the frequencies to be reproduced);

loading of the diaphragm by a quasi-closed volume on the backside of the dome, the internal magnetic construction being opened toward said quasi-closed volume, said quasi-closed volume comprising a minimal pneumatic leakage (generally, a pressure balancing mean having a long time constant) the time constant of which is very long relative to the frequencies to be reproduced, said leakage having specially the form of a porous material or of a port with a very small diameter or of a fine tube (of capillary or needle type) toward the outside of the transducer;

a mechanical return mean, such as a spring or a resilient material, between the dome or the mandrel and a fixed part of the transducer;

an electronic feedback control of the position of the coil;

such a configuration of the coil and the internal and external magnetic constructions that a return force (rebalancing) is exerted on the coil by an electromagnetic effect (for example, such that the value of the self-inductance of the coil is maximal for a determined position of the coil along the height of the vertical free space, within the air gap)

a deformation of the mandrel in the ferrofluidic seal area relative to the vertical generating line sweeping the mandrel, said deformation extending along the circumference of the mandrel being defined so as to create a return force proportional to the movement of the coil;

further, implementing of vertical (or even oblique) ferrofluidic seal segments, each vertical seal segment being in relation with a deformation along a segment of a mandrel vertical (or oblique) generating line, the vertical (or oblique) deformations being defined so as to create a return force proportional to the movement of the coil;

one or more (general or local) deformations in the area of the ferrofluidic seals, specially deformations along segments of mandrel vertical generating lines, said deformation being defined so as to create a return force proportional to the movement of the coil, the transducer comprises two internal and unilateral ferrofluidic seals at least one of which is continuous, said ferrofluidic seals being arranged in concave deformations as seen from the inside of the mandrel (the magnetic field confinement means in the vertical free space are therefore arranged at these levels), the coil being arranged on the external face of the mandrel toward the external volume (the ferrofluid being therefore advantageously arranged inside the internal volume which is much smaller than the internal volume) and the diaphragm is loaded by a quasi-closed volume on the backside of the dome, the internal magnetic construction being axially opened toward said quasi-closed volume arranged on the backside of the internal magnetic construction, said quasi-closed volume comprising a pneumatic leakage the time constant of which is very long relative to the frequency to be reproduced, the leakage being a port with a very small diameter toward the outside of the transducer, the transducer is of circular mandrel type, the transducer is of elliptical mandrel type.

BRIEF DESCRIPTION OF THE DRAWINGS

The present invention will now be exemplified, without thereby being limited, by the following description of an application to a loudspeaker and in conjunction with the following drawing:

FIG. 1 which shows a vertical section passing through the anteroposterior symmetry axis of a circular dome type loudspeaker according to the invention and with several examples of return means for the coil, some of which being shown in dotted line;

DETAILED DESCRIPTION OF THE PREFERRED EMBODIMENTS

The application to loudspeakers has shown in an embodiment that it is possible to obtain displacements of the coil of approximately +/−6 mm. More important displacements are also possible, in particular with field confinement means enabling a strong concentration of the magnetic field in the ferrofluidic seal areas, the mandrel being even able to slide over the seals which stay in place.

Besides improving the thermal dissipation, the ferromagnetic liquid, which tends naturally to position itself in areas in which the magnetic field is the greatest (the most concentrate) and/or the field variation is the highest, will be able to act as a pneumatic seal between the front side and the rear side of the diaphragm, if it is continuous, and, in all cases, it will ensure the translation guidance of the mandrel in the vertical free space, given the suppression of external mechanical guiding elements for the mandrel, such as the edges of the diaphragm and/or the "spiders". To ensure this guiding function, it is preferable that at least two ferrofluidic seals (for at least a double guidance) be present at different heights along the mandrel in the vertical free space, and preferably on either side of the coil(s) winded on the mandrel. According to some variants, the ferrofluidic seals can be on only one side of the coil, in the height direction (either all above or all below), in particular in the case the field concentration system is distinct from the principal motor, as in the case of using a traditional motor and adding specific field concentration means on this traditional motor).

In FIG. 1, the electrodynamic motor of the loudspeaker 1 having a dome 2, with the coil 6 and the external 5 and internal 4 magnetic constructions thereof, thus comprises means 11 to create magnetic field concentrations in the vertical free space, at levels (heights) at which ferrofluidic seals, which can be internal or external, bilateral or unilateral ones, are desired. Preferably, each ferrofluidic seal is, along the circumference of the mandrel, in a single own plane perpendicular to the symmetry axis of the mandrel, as shown. According to some alternatives/variants, the seal along the circumference of the mandrel can draw a profiled curve (sinusoidal, triangular, square frieze, rectangular . . . ) and form a profiled seal. In the latter case, given that a same seal runs at different heights along the circumference of the mandrel, a single seal of this type can ensure a double guidance. These ferrofluidic seals are continuous (at least one of them) or discontinuous. Further, according to some variants, segments of vertical or oblique seals can be implemented. The field confinement means are adapted accordingly. It will be understood that the substantially horizontal parts of seals in deformations of the mandrel fulfill a predominant returning function, the (optionally) vertical or oblique parts of the seals in deformations of the mandrel ensuring a regular sliding of the mandrel and a possible returning function (according to the shape of the mandrel's deformations, in particular of the top and bottom ends thereof).

In FIG. 1, two bilateral seals 12 have been implemented on either side of the mandrel 3 bearing the coil 6, each bilateral seal 12 being comprised by an internal part 13 in the internal volume of the vertical free space, on the internal magnetic construction 4 side, and an external part 14 in the external volume of the vertical free space, on the external magnetic construction 5 side. The motor is inside a rigid frame, only a front part 7 of which has been represented, with fixation means to a support which can be for example the face of an enclosure. The external and internal magnetic constructions can be passive ones, that is to say only comprising guiding means for a magnetic field created in the other construction, or they can be active ones, that is to say they comprise one or more magnetic field generating means (one or more magnets of ring/pellet/composite/single-part type . . . ), or they can be of the mix type, that is to say they combine the two above types (one or more magnetic field generating means and magnetic field guiding means).

Then, by creating at least two field concentration areas distributed along the height of the mandrel, for example on either side of the coil (or of the coils/between the coils), it is possible to make ferromagnetic liquid seals at different heights of the mandrel. These ferrofluidic seals extend horizontally, at least between one of the two walls of the vertical free space and the respective face of the mandrel, forming an unilateral seal, and at most, they extend to a same given height, on one side, between a first of the two walls of the vertical free space and the respective face of the mandrel, and on the other side, between the other face of the mandrel and the second wall of the vertical free space, forming a bilateral seal. It will be understood that these seals (at least two seals stepped along the mandrel) ensure by themselves a holding and at least a double guidance of the mandrel (guiding function) in the vertical free space.

At least one of the ferrofluidic seals has to be continuous to provide an efficient pneumatic isolation (sealing function) between the front side and the rear side of the diaphragm, in the case in point a dome 2. So, thanks to this continuous seal on the circumference of the mandrel (unilateral or bilateral seal), the rear part of the dome (inside the loudspeaker) is pneumatically isolate from the front part (on the front side of the dome and corresponding to the environment of the loudspeaker). It will be understood that the selection of a bilateral or an unilateral seal, and for the latter of the internal or external positioning thereof, can depend on whether the bottom of the vertical free space is opened or not toward the outside: if it is opened, it will then be necessary to arrange at least one continuous seal, on the internal space side (continuous internal and unilateral seal or bilateral seal, because the latter comprises both an internal part and an external part).

In FIG. 1, it is also shown possible means for the returning of the coil to a predefined position (returning function) when this one is no longer electrically excited (or after the suppression of an incidental external bias). However, it is to be reminded that some of the possible return means can't be graphically represented in this simplified figure, and that is the case for the implementation of an electronic feedback control of the position of the coil or for a configuration of particular electrodynamic characteristics of the motor with its coil (for example, the maximal value of the self-inductance at a given position of the coil).

Regarding the return means which are visible in FIG. 1, there are:

(in solid line) an implementation of a closed volume on the backside of the diaphragm, so as to thus load the dome, this closed volume, closed by a wall 9, being in the case in point a quasi-closed volume 8, because a minimal-leakage, in the form of a port 10, has been provided. The time constant of the port (the time which is required to balance the pressures between the two sides of the port) is very long relative to the frequencies to be reproduced by the loudspeaker. The port has thus a very small diameter or can be replaced/supplemented by a porous material or by a fine tube (of capillary or needle type). It can be noticed that, in order to load the backside of the dome with that quasi-closed volume, arranged essentially on the backside of the motor, the central core of the motor is opened toward the backside of the loudspeaker;

(in dotted line) an implementation of a mechanical return mean, such as a spring 15, between the dome 2 and the central fixed part of the motor, in the case in point the internal magnetic construction 4;

(in dotted line) an implementation of a mechanical return mean, such as a resilient material, between the mandrel and a fixed part of the motor, in the case in point the end of the mandrel at the bottom of the vertical free space by the perforated resilient diaphragm 16.

It will be understood that the mechanical return means can be arranged at other places, for example the perforated diaphragm, in a resilient material, arranged on the backside of the dome, in place of the spring. Further, the mechanical return means have to exert balanced return forces on the circumference of the mandrel/dome so as to avoid the compromising of the guidance and, advantageously, to be implemented so as to obtain a return force proportional to the movement of the coil.

In another example embodiment of the return means, by optimization of the mandrel's shape, the mandrel generating line is no longer a vertical line on the whole height of the mandrel but presents concavities (or convexities according to the considered face) in areas in which the ferrofluid will be placed. Then, two internal and unilateral ferrofluidic seals are arranged in concavities of the mandrel, on either side (regarding the height) of the coil which is external relative to the mandrel. At least one of the ferrofluidic seals is continuous along the periphery (circumference) of the mandrel to ensure the sealing function. The deformations of the mandrel are defined so as to obtain a return force proportional to the moving of the coil.

Those different return means can be used alone or combined in a loudspeaker.

Generally and preferably, in case of at least two unilateral seals, these ones are either together on the inner side of the mandrel or together on the outer side of the mandrel (however, according to a variant, it is possible to alternate the unilateral seals on each side of the mandrel). The selection of the side where to place the unilateral seals can be linked to the fact that the coil forms a protuberance on the mandrel and that the mandrel will thus have to be spaced from the face (coil side) bounding the free space in front of the coil for the latter not to rub against said face, and the seals are then placed on the other side (if the coil is on the outer side of the mandrel, the seals will be on the inner side of the mandrel), and thus inside the smallest free volume. Then, the ferrofluid is advantageously arranged in the space in which the volume is the most reduced, for example, in FIG. 1, advantageously inside the volume 13 rather than inside the volume 14.

It will be understood that further embodiments are possible through combinations/suppressions/exchanges of described means or other conventionally known means without thereby departing from the general scope of the invention. Then, the ferrofluidic guidance can be implemented in a manner equivalent to two (or more) seals by mean of a set of vertical seals distributed on the circumference of the mandrel, preferably in an equiangular manner, it will be understood that the sealing function would no longer be present with these vertical seals only and that it is then necessary either to add a continuous circular seal or to link the vertical seals to each other along the circumference. A further advantage with the arrangement of vertical (or oblique or profiled) seals, when the mandrel has a corresponding deformation at their levels, is to avoid a possible rotation of said mandrel around the symmetry axis thereof. In a variant, one or more circular seals are associated to vertical seals, by joining each other. On the other hand, a circular seal can either be in a single horizontal plane or be profiled, and then be placed at different heights along the circumference. In all these cases, the field confinement means are adapted to the shape/construction of the seal(s). Finally, to improve the sliding of the mandrel over the ferrofluidic seals in the parts in which it is useful (in particular in the deformations of vertical or oblique segments of seals), the mandrel can be covered with a coating which is non-wettable by the ferrofluid (ferrofluidophobic). On the other hand, to improve the seal strength and the holding/returning of the mandrel, the mandrel can be covered with a coating which is wettable by the ferrofluid (the ferrofluid "catches" on the mandrel) (ferrofluidophilic), in the parts in which it is useful (in particular at the bottom of the deformations of the mandrel helping for the return means). Finally, in case of several coils on a same face of the mandrel, the spacing between the coils appears set back (it is the mandrel itself) relative to the coils themselves and it can also acts as an area in which a ferrofluidic seal can be confined.

The invention claimed is:

1. An electrodynamic transducer (1) with a diaphragm (2), comprising:

an electrodynamic motor in a yoke (7) and in which can move a coil (6) borne by a mandrel (3) integral with the diaphragm, the mandrel having a shape generated by a globally linear generating line, the coil being placed in an air gap of a vertical free space in which the coil can move and which is defined, toward the center of the transducer, by an internal magnetic construction (4), and toward a periphery of the transducer, by an external magnetic construction (5), characterized in that the transducer comprises neither peripheral suspension nor internal suspension, the peripheral suspension being a suspension between a periphery of the diaphragm and the yoke, the internal suspension being a suspension between the diaphragm or the mandrel and the yoke, and in that the transducer comprises, in the vertical free space, at least two areas of concentrated magnetic field (11) in order to form, by way of a ferromagnetic liquid, at least two ferrofluidic seals (12, 13, 14) stepped in the vertical free space, fulfilling at least a double guidance of the coil and the pneumatic tightness between front and rear faces of the diaphragm, at least one of the at least two ferrofluidic seals being continuous.

2. The transducer according to claim 1, characterized in that the transducer is a loudspeaker, the diaphragm is a dome, the yoke is a frame, the peripheral suspension is an edge, and the internal suspension is a "spider".

3. The transducer according to claim 1, characterized in that at least one of the ferrofluidic seals is an internal and unilateral seal (13), the ferromagnetic liquid of said seal being arranged inside an internal volume.

4. The transducer according to claim 1, characterized in that at least one of the ferrofluidic seals is an external and unilateral seal (14), the ferromagnetic liquid of said seal being arranged inside an external volume.

5. The transducer according to claim 1, characterized in that at least one of the ferrofluidic seals is a bilateral seal (12), the ferromagnetic liquid being arranged inside the external volume and inside the internal volume, substantially at a same height for a same bilateral seal.

6. The transducer according to claim 3, characterized in that it comprises only unilateral ferrofluidic seals, either exclusively external or exclusively internal.

7. The transducer according to claim 6, characterized in that, when the seals are external and unilateral seals, the coil is arranged inside the internal volume on the internal face of the mandrel and, when the seals are internal and unilateral seals, the coil is arranged inside the external volume on an external face of the mandrel.

8. The transducer according to claim 1, characterized in that it further comprises a return means for the coil.

9. The transducer according to claim 8, characterized in that the return means for the coil is selected among one or more selected from the group consisting of:

loading of the diaphragm by a closed volume on a backside of the dome, the internal magnetic construction being opened toward the closed volume;

loading of the diaphragm by a closed volume on the backside of the dome, the internal magnetic construction being opened toward the closed volume which comprises an adjusting device for an internal pressure thereof;

loading of the diaphragm by a quasi-closed volume on the backside of the dome, the internal magnetic construction being opened toward said quasi-closed volume, said quasi-closed volume comprising a minimal pneumatic leakage a time constant of which is very long relative to the frequencies to be reproduced, said leakage having the form of one of a porous material, a port with a very small diameter, or a fine tube toward the outside of the transducer;

a mechanical return device between the dome or the mandrel and a fixed part of the transducer;

an electronic feedback control of a position of the coil;

such a configuration of the coil and the internal and external magnetic constructions that a return force is exerted on the coil by an electromagnetic effect;

a deformation (13) of the mandrel in the ferrofluidic seal area relative to a vertical generating line sweeping the mandrel, said deformation extending along the circumference of the mandrel defined so as to create a return force proportional to the movement of the coil;

further, implementing of vertical ferrofluidic seal segments, each vertical seal segment being in relation with a deformation along a segment of a mandrel vertical generating line, the vertical deformations being defined so as to create a return force proportional to the movement of the coil; and one or more deformations in the area of the ferrofluidic seals, said deformation being defined so as to create a return force proportional to the movement of the coil.

10. The transducer according to claim 7, characterized in that it further comprises two internal and unilateral ferrofluidic seals, at least one of which is continuous, said ferrofluidic seals being arranged in concave deformations as seen from an inside of the mandrel, the coil being arranged on the external face of the mandrel toward the external volume, and in that the diaphragm is loaded by a quasi-closed volume on the backside of the dome, the internal magnetic construction being axially opened toward said quasi-closed volume arranged on a backside of the internal magnetic construction, said quasi-closed volume comprising a pneumatic leakage, a time constant of which is very long relative to the frequency to be reproduced, said leakage being a port with a very small diameter toward the outside.

11. The transducer according to claim 2, characterized in that at least one of the ferrofluidic seals is an internal and unilateral seal (13), the ferromagnetic liquid of said seal being arranged inside an internal volume.

12. The transducer according to claim 2, characterized in that at least one of the ferrofluidic seals is an external and unilateral seal (14), the ferromagnetic liquid of said seal being arranged inside an external volume.

13. The transducer according to claim 3, characterized in that at least one of the ferrofluidic seals is an external and unilateral seal (14), the ferromagnetic liquid of said seal being arranged inside an external volume.

14. The transducer according to claim 2, characterized in that at least one of the ferrofluidic seals is a bilateral seal (12), the ferromagnetic liquid being arranged inside the external volume and inside the internal volume, substantially at a same height for a same bilateral seal.

15. The transducer according to claim 3, characterized in that at least one of the ferrofluidic seals is a bilateral seal (12), the ferromagnetic liquid being arranged inside the external volume and inside the internal volume, substantially at a same height for a same bilateral seal.

16. The transducer according to claim 4, characterized in that at least one of the ferrofluidic seals is a bilateral seal (12), the ferromagnetic liquid being arranged inside the external volume and inside the internal volume, substantially at a same height for a same bilateral seal.

17. The transducer according to claim 4, characterized in that it comprises only unilateral ferrofluidic seals, either exclusively external or exclusively internal.

18. The transducer according to claim 2, characterized in that it further comprises a return means for the coil.

19. The transducer according to claim 3, characterized in that it further comprises a return means for the coil.

20. The transducer according to claim 4, characterized in that it further comprises a return means for the coil.

* * * * *